US006537333B2

(12) United States Patent
Hipp et al.

(10) Patent No.: US 6,537,333 B2
(45) Date of Patent: Mar. 25, 2003

(54) PROCESS AND COMPOSITION OF SULFUR DYES

(75) Inventors: J. Michael Hipp, Iron Station, NC (US); Mark S. Carlough, Concord, NC (US); William T. Sherrill, Charlotte, NC (US); Peter J. V. Stahala, Cornelius, NC (US)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 09/898,996

(22) Filed: Jul. 3, 2001

(65) Prior Publication Data

US 2002/0069468 A1 Jun. 13, 2002

Related U.S. Application Data

(60) Continuation-in-part of application No. 09/447,128, filed on Nov. 22, 1999, now abandoned, which is a division of application No. 09/215,025, filed on Dec. 17, 1998, now Pat. No. 6,019,800.

(51) Int. Cl.[7] ..... C09B 67/00; D06P 1/46; D06P 1/52

(52) U.S. Cl. ..... 8/554; 8/555; 8/559; 8/561; 8/651

(58) Field of Search ..... 8/554, 555, 559, 8/561, 651

(56) References Cited

U.S. PATENT DOCUMENTS

| | | | |
|---|---|---|---|
| 1,758,865 A | | 5/1930 | Straub et al. |
| 3,294,475 A | | 12/1966 | Heid et al. |
| 3,415,808 A | | 12/1968 | Weber et al. |
| 4,300,904 A | | 11/1981 | Blanchard |
| 5,053,078 A | * | 10/1991 | Koike et al. |
| 5,240,466 A | | 8/1993 | Bauer et al. |
| 5,257,036 A | * | 10/1993 | Koike et al. |
| 5,632,782 A | | 5/1997 | Carlough |
| 5,922,087 A | | 7/1999 | Nishioka et al. |

FOREIGN PATENT DOCUMENTS

| | | |
|---|---|---|
| EP | 0 274 216 | 7/1988 |
| EP | 0 501 197 | 9/1992 |
| EP | 0 738 766 | 10/1996 |
| GB | 217936 | 4/1925 |
| GB | 342466 | 8/1930 |
| GB | 366472 | 7/1931 |
| GB | 435342 | 8/1934 |
| GB | 573831 | 5/1944 |

OTHER PUBLICATIONS

PCT Search Report for International application No. PCT/IB 99/02015, mail date Mar. 17, 2000.

Color Index, Thrid Edition, vol. 2, The Society of Dyers and Colourists, American Association of Textile Chemists and Colorists, Yorkshire England & Research Triangle Park, NC 1971, p. 2019.

* cited by examiner

*Primary Examiner*—Margaret Einsmann
(74) *Attorney, Agent, or Firm*—Scott E. Hanf

(57) ABSTRACT

A process for dyeing a fibrous substrate which comprises the steps of: providing a fibrous substrate; providing at least one sulfur dye; providing at least one reduction stable direct dye; and applying said reduction stable direct dye and sulfur dye to said fibrous substrate in the presence of a suitable reducing agent. Further, it has been surprising to find that these reduction stable direct dyes can be processed without a sulfur dye present. This results in a process for dyeing a fibrous substrate which comprises the steps of: providing a fibrous substrate; providing a reduction stable direct dye; and applying said reduction stable direct dye to said fibrous substrate in the presence of a suitable reducing agent.

5 Claims, No Drawings

PROCESS AND COMPOSITION OF SULFUR DYES

This application is a continuation-in-part application of application Ser. No.: 09/447,128, filed Nov. 22, 1999 abandoned which is a divisional application of Ser. No. 09/215,025 filed on Dec. 17, 1998, now U.S. Pat. No. 6,019,800, granted on Feb. 1, 2000.

FIELD OF THE INVENTION

The present invention is directed to a process for dyeing fibrous substrates which comprises the steps of: providing a fibrous substrate; providing at least one sulfur dye; providing at least one reduction stable direct dye; and applying said reduction stable direct dye to said fibrous substrate in the presence of a suitable reducing agent.

BACKGROUND OF THE INVENTION

As has been known for many years, sulfur dyes are advantageously used in the dyeing and/or printing of cellulose fiber materials and/or cellulosic blended textile fibers. In traditional dyeing processes the sulfur dyes are applied in the alkali soluble (pre)reduced form, i.e. "leuco state", and are brought in contact with the cellulosic fibers in one of a variety of methods and subsequently oxidized in order to achieve color development and/or impart a degree of dye fastness to the dyed cellulosic textile substrate.

Reducing agents traditionally employed for the application of sulfur dyes are in particular: sodium hydrogen sulphide, sodium sulfide and sodium polysulphides. Other chemical reducing agents that do not contain sulfide ions (i.e. "non-sulfide" reducing agents) known to be useful for the reduction of sulfur dyestuffs include: sodium borohydride, formamidinesulphinic acid, glyceraldehyde, hydroxyacetone, hydroxylamine sulfate, lignin sulphonates, sodium formaldehydesulphoxylate, sodium hydrosulphite, thioglycolic acid, and various reducing sugars.

The prior art teaches the processing of only vat and sulfur dyes in a reducing medium. It has been believed that the use of direct dyes in such conditions would result in the destruction of the chromophore. Direct dyes may have been used to shade sulfur dyeings but not applied in combination with sulfur dyes dyed simultaneously in a reduction medium.

SUMMARY OF THE INVENTION

A process for dyeing a fibrous substrate which comprises the steps of: providing a fibrous substrate; providing at least one sulfur dye; providing at least one reduction stable direct dye; and applying said reduction stable direct dye and sulfur dye to said fibrous substrate in the presence of a suitable reducing agent.

Further, it has been surprising to find that these reduction stable direct dyes can be processed without a sulfur dye present. This results in a process for dyeing a fibrous substrate which comprises the steps of: providing a fibrous substrate; providing a reduction stable direct dye; and applying said reduction stable direct dye to said fibrous substrate in the presence of a suitable reducing agent.

Still further, it has been surprising to find that reduction stable direct dyes can be processed with vat dyes and optionally also sulfur dyes. The result is a process for dyeing a fibrous substrate which comprises the steps of: providing a fibrous substrate; providing at least one vat dye; providing at least one reduction stable direct dye; and applying said reduction stable direct dye and vat dye to said fibrous substrate in the presence of a suitable reducing agent.

DESCRIPTION OF THE PREFERRED EMBODIMENTS

A process for dyeing a fibrous substrate which comprises the steps of: providing a fibrous substrate; providing at least one sulfur dye; providing at least one reduction stable direct dye; and applying said reduction stable direct dye and sulfur dye to said fibrous substrate in the presence of a suitable reducing agent.

The fibrous substrate is selected from the group of: cellulosic fibrous material, cellulosic-mixed fiber materials, and blends of cellulosic fibers with synthetic non-cellulosic fiber. By "cellulosic fibrous material" it is to be understood a substrate which comprises cellulose fibers and which may further comprise non-cellulosic fibers, which may be mixed with the cellulosic fibers, and is preferably textile material. Contemplated non-cellulosic fibers include semi-synthetic and fully synthetic polymeric fibrous material including, but not limited to, cellulose acetates, polyamides (alkyl and aromatic), polyesters, polyolefins, polyacrylonitriles, as well as others known in the art as useful in forming mixed fiber blends with cellulosic fibers. Further, the fibers may be in any conventional form, including, but not limited to, raw stock, threads, yarns, or in semi-finished product form, that is to mean, in the form of twisted hanks or skeins of yarns or fibers, spooled threads, knitted or woven textile such as fabrics, as well as in final product form such as garments.

The sulfur dyes (S) which may be used in accordance with the process of the invention include those which are either provided in the non-reduced form ($S_1$) for subsequent reduction by suitable sulfur dye reducing agent(s) in the application bath, or they may be provided to the bath as pre-reduced sulfur dyes ($S_2$), in particular as liquid concentrated compositions, which are frequently aqueous alkaline solutions containing the alkali soluble leuco sulfur dye thiolate, or as dry compositions. As pre-reduced sulfur dyes ($S_2$) there are more specifically meant pre-reduced sulfur dyes which are in a partially reduced form as is sufficient in order to be readily soluble in alkaline solutions and which may, if desired, be further reduced for application, and further or fully reduced sulfur dyes which are readily soluble in alkaline solutions and are directly usable for application. Both are embraced by the term leuco sulfur dyes. Solubilized sulfur dyes (Bunte salts)($S_3$) may also be employed according to the invention.

Exemplary sulfur dyes (S) which may be utilized in accordance with the process of the invention include but are not necessarily limited to the following ("C.I." stands for "Colour Index"):

C.I. Sulfur Yellow 1, 2, 3, 4, 5, 6, 8, 9, 10, 11, 12, 13, 14, 16, 20 and 23, C.I. Leuco Sulfur Yellow 2, 4, 7, 9, 12, 15, 17, 18, 21, 22 and 23 and C.I. Solubilized Sulfur Yellow 2, 4, 5, 19, 20 and 23;

C.I. Sulfur Orange 1, 2, 3, 4, 5, 6, 7 and 8, C.I. Leuco Sulfur Orange 1, 3, 5 and 9 and C.I. Solubilized Sulfur Orange 1, 3, 5, 6, 7 and 8;

C.I. Sulfur Red 1, 2, 3, 4, 5, 6, 7, 8, 9, 10, 12 and 13, C.I. Leuco Sulfur Red 1, 4, 5, 6, 11 and 14 and C.I. Solubilized Sulfur Red 3, 6, 7, 11 and 13;

C.I. Sulfur Violet 1, 2, 3, 4 and 5, C.I. Leuco Sulfur Violet 1 and 3 and C.I. Solubilized Sulfur Violet 1;

C.I. Sulfur Blue 1, 2, 3, 4, 5, 6, 7, 8, 9, 10, 11, 12, 13, 14, 15, 16, 17, 18 and 19, C.I. Leuco Sulfur Blue 1, 2, 3, 5, 7, 8, 9, 11, 13, 15 and 20 and C.I. Solubilized Sulfur Blue 1, 2, 4, 5, 6, 7, 10, 11, 13, and 15;

C.I. Sulfur Green 1, 2, 3, 4, 5, 6, 7, 8:1, 9, 10, 11, 12, 13, 14, 15, 16, 17, 18, 19, 20, 21, 22, 23, 24, 25, 26, 27, 28, 29, 31, 32 and 33, C.I. Leuco Sulfur Green 1, 2, 3, 4, 7, 11, 16 30, 34, 35, 36, and 37 and C.I. Solubilized Sulfur Green 1, 2, 3, 6, 7, 9, 19, 26 and 27;

C.I. Sulfur Brown 1, 2, 3, 4, 5, 6, 7, 8, 9, 10, 11, 12, 13, 14, 14:1, 15, 15:1, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 53:1, 54, 55, 56, 57, 58, 59, 60, 61, 62, 63, 64, 65, 66, 67, 68, 69, 70, 71, 72, 73, 74, 76, 77, 78, 79, 84, 85, 87, 88, 89, 90, 91, 93 and 94, C.I. Leuco Sulfur Brown 1, 3, 4, 5, 8, 10, 11, 12, 14, 15, 21, 23, 26, 31, 37, 43, 44, 81, 82, 86, 87, 90, 91, 92, 93, 94, 95 and 96 and C.I. Solubilized Sulfur Brown 1, 4, 5, 8, 10, 11, 12, 14, 15, 16, 21, 26, 28, 31, 51, 52, 56, 60, 75, 80 and 83;

C.I. Sulfur Black 1, 2, 3, 4, 5, 6, 7, 8, 9, 10, 11, 12, 13, 14, 15, 16 and 17, C.I. Leuco Sulfur Black 1, 2, 6, 9, 10, 11 and 18 C.I. Solubilized Sulfur Black 1, 2, 5, 7 and 11.

A more complete and particularized listing of the dyestuffs mentioned above may be found in the Colour Index, 3rd. Ed., published by the Society of Dyers and Colourists (London, GB), as well as in the supplementary volumes published thereto.

The sulfur dyes (S) may be employed in a form as commercially available; the soluble reduced or pre-reduced, i.e. leuco sulfur dyes ($S_2$), may in particular be employed in a form as commercially available, and may contain some residual excess reducing agent from their production, and, especially in the liquid form, may contain if required or desired, some added reducing agent in order to stabilize the reduced form against the oxidizing influence of the surrounding air.

The reduction stable direct dye has proven to be a surprising element in this process. Sulfur dyes are defined as, one of a group of dyes produced by heating various organic compounds with sulfur. The characteristic chromophore groupings are ≡C—S—C≡ and ≡C—S—S—C≡; with C.I. numbers range from 53000 to 54999. Like Vat dyes, sulfur dyes are reduced to a water-soluble, "leuco", form for application and are oxidized to their original colored state for fixation. However it has been discovered that these direct dyes, which are not classified as sulfur or vat dyes, can be processed like sulfur dyes and color yield is unaffected or even improved after reduction. A prime example of this is C.I. Direct Blue 86, 189 or 199. These colors are all classified as direct dyes, and yet surprisingly the chromophore is not destroyed by the reduction process and color strength improved over the current art of applying these colors as direct dyes. In addition, it was found that enhanced wash fastness properties were obtained. Direct Yellow 148:1 also behaves in this manner. For purposes of this invention, reduction stable does not mean inert or unaffected by the reduction. Reduction stable as used in this specification and claims means: a compound whose chromophore is not destroyed by undergoing reduction. While the original color of the compound may be somewhat altered by the reduction, it still yields a commercially acceptable color. Surprisingly, many of these direct dyes exhibit enhanced tinctorial strength or improved wash fastness, or both, when processed in a reducing medium. When these reduction stable direct dyes are processed together with sulfur dyes or vat dyes or combinations of sulfur dyes and vat dyes, enhanced tinctorial strength or improved wash fastness, or both improved wash fastness and tinctorial strength has been observed in some cases when processed in a reducing medium. In many cases these increases are more than an additive effect which suggests an unexpected synergy between these components.

Suitable reducing agents include sodium hydrogen sulfide, sodium sulfide and a sodium polysulphide. Other chemical reducing agents that do not contain sulfide ions (i.e. "non-sulfide" reducing agents) known to be useful for the reduction of sulfur dyestuffs include: sodium borohydride, formamidinesulphinic acid, glyceraldehyde, hydroxyacetone, hydroxylamine sulphate, a lignin sulphonate, sodium formaldehydesulphoxylate, sodium hydrosulphite, thioglycolic acid, and one or more of various reducing sugars.

The non-sulphide reducing agent(s) (R) are preferred for environmental reasons. These non-sulfide reducing agent(s) (R) can be employed in the dyebath and may be utilized to reduce a sulfur dye ($S_1$) or ($S_3$), or a pre-reduced dye may be present in the dyebath, or the reducing agent may be utilized to maintain the reduced condition (leuco form) of pre-reduced dyes ($S_2$).

The dyeing is suitably carried out under alkaline conditions, preferably at a pH≧10. The liquor-to-goods ratio may be in any range as suitable for the particular method of dyeing and machine used. The concentration of (R) may be chosen depending on amount and concentration of the dye and on the nature of (R) and may further vary depending on the kind of substrate and particular dyeing method. The reducing agent (R) is suitably added in any amount which is found to adequately reduce a sulfur dye, in particular ($S_1$) and also ($S_3$), to its reduced form under the operating dyeing conditions, and/or to maintain the reduced condition of pre-reduced sulfur dyes, in particular ($S_2$). Also the dyeing temperature may vary depending on the dyeing method and apparatus, and is advantageously in the range 35° to 130° C.

Further, it has been surprising to find that these reduction stable direct dyes can be processed without a sulfur dye present. This results in a process for dyeing a fibrous substrate which comprises the steps of: providing a fibrous substrate; providing a reduction stable direct dye; and applying said reduction stable direct dye to said fibrous substrate in the presence of a suitable reducing agent.

These reduction stable direct dyes can also be prepared as a concentrated pourable aqueous liquid composition capable of reduction. As is well known in the dye art, an "aqueous" solution, composition or suspension is one that is substantially free of any organic solvent. By "concentrated" it is meant that the amount of the dye(s) in the dye composition is greater than the limit of solubility of such dye(s). These concentrated pourable aqueous liquid compositions comprise: a reduction stable direct dye; and a suspension stabilizing agent in an amount effective to maintain a uniform distribution of reduction stable direct dye in suspension for a period of at least 24 hours. The suspension stabilizing agent being one or more water-soluble compounds is being present in an amount of less than 10% by weight of the composition. This suspension stabilizing agent is selected from the group of: carboxymethyl cellulose, xantham gum, gum arabic, polyacrylamide, and combinations thereof.

A soluble dye has a defined limit of solubility in a given solvent, such as water for aqueous solutions. When this point is reached the solution is saturated. If the concentration of the dye(s) is above this limit, the excess dye will not dissolve in the solvent, but is undissolved and will form suspended matter. If more than one dye is dissolved in the same solvent, the limit of solubility for each component may be even lower. The proportion of undissolved or suspended dye may increase because of the combined mass action. The limit of solubility for direct dyes and for leuco sulfur dyes may be significantly different, and often solubility may be different from dye to dye within the same class of dyes. The concentrated dye compositions of the present invention contain suspended (undissolved) dye(s) and, thus the requirement for a suspension stabilizing agent is critical to allow the use of such concentrated dye formulations having a higher loading of dye(s).

These pourable aqueous dye compositions can optionally further comprise a preservative, a biocide or a fungicide or combinations thereof; to control or inhibit growth of unwanted microorganisms. This becomes important in cases where the suspension may be stored before use. Usually these additives are added in a range of 0.01 to 0.5%, by weight of the liquid phase of the suspension. An example of a biocide would be a glutaraldehyde biocide AMA-4750. An example of a fungicide is Givgard DXN. Preservative as used here can mean a biocide, a fungicide or any other substance, known in the art, which prolongs the useful life of the dye composition.

Dye blends containing both sulfur and direct dyes can be prepared as a concentrated pourable aqueous liquid composition capable of reduction. This concentrated pourable aqueous liquid dye composition comprises: a sulfur dye, a reduction stable direct dye, and a suspension stabilizing agent in an amount effective to maintain a uniform distribution of sulfur dye in suspension for a period of at least 24 hours. This suspension stabilizing agent being present in an amount of less than 10% by weight of the composition. The preferred sulfur dye present has a content of inorganic sulfides and inorganic polysulfides, such that, upon being acidified to a pH 3 in phosphoric acid at 22° C., the dye will generate no more hydrogen sulfide than can react with aqueous sodium hydroxide to form 1000 ppm of sulfide ion, based on the weight of the sulfur dye. The suspension stabilizing agent is selected from the group of: carboxymethyl cellulose, xantham gum, gum arabic, polyacrylamide, and combinations thereof. The said sulfur dye is selected from the group of: a non-reduced sulfur dye ($S_1$); a pre-reduced sulfur dye ($S_2$); and a solubilized sulfur dye (Bunte salt) ($S_3$).

A further dye composition containing both one or more vat dyes and one or more direct dyes can be prepared as a pourable aqueous liquid dye composition capable of reduction, comprising: a vat dye and a reduction stable direct dye. While many vat dyes can be used, C.I. vat blue 1, C.I. vat blue 2, C.I. vat blue 3, C.I. vat blue 4 are all of interest. C.I. vat blue 1, or Indigo, has demonstrated a synergistic effect when combined with certain reduction stable direct dyes.

This vat/direct dye blend can be further concentrated and higher dye loadings achieved through the addition of a suspension stabilizing agent. This suspension stabilizing agent is added in an amount effective to maintain a uniform distribution of dye in suspension for a period of at least 24 hours. Usually the suspension stabilizing agent is present in an amount of less than 10% by weight of the suspension. The suspension stabilizing agent is selected from the group of: carboxymethyl cellulose, xantham gum, gum arabic, polyacrylamide, and combinations thereof.

In the vat/direct dye blend, one or more additives can be added to prolong the life of the blend. The additive is selected from the group of: a preservative, a biocide, a fungicide and combinations thereof.

These vat/direct dye blends optionally further comprise at least one sulfur dye. The sulfur dye is selected from the group of: a non-reduced sulfur dye ($S_1$), a solubilized sulfur dye (Bunte salt) ($S_3$), and combinations thereof. The resulting vat/sulfur/direct dye blend can be further modified with one or more suspension agents and additives to protect against micro-organisms. Multiples of vat dyes, sulfur dyes or direct dyes, or combinations thereof, can be prepared to achieve colors that have not been achievable with only sulfur or vat dyes, at present.

In using vat dyes, in many cases, a dispersing agent will be added. The dispersing agent is selected from the group of: a lignin sulfonate and a naphthalenesulfonic acid condensate. The suspension agents and additive to protect against micro-organisms already discussed can be used in conjunction with one or more dispersing agents. Any combination of dispersing agents, suspension agents and additives can be used with either the vat/direct dye blend or a vat/sulfur/direct dye blend.

The process for dyeing with blends of vat and direct dyes differs slightly from blends of sulfur and direct dyes. A process for dyeing a fibrous substrate, which comprises the steps of: providing a fibrous substrate; providing at least one vat dye, providing at least one reduction stable direct dye, and applying said reduction stable direct dye and vat dye to said fibrous substrate in the presence of a suitable reducing agent. The fibrous substrate is selected from the group of: cellulosic fibrous material, cellulosic-mixed fiber material, and blends of cellulosic fibers with synthetic non-cellulosic fibers. Suitable reducing agents are selected from the group of: sodium hydrogen sulfide, sodium sulfide, a sodium polysulphide, sodium borohydride, formamidinesulphinic acid, glyceraldehyde, hydroxyacetone, hydroxylamine sulfate, a lignin sulphonate, sodium formaldehydesulphoxylate, sodium hydrosulphite, thioglycolic acid, and one or more of various reducing sugars.

The process for dying a blend of vat and reduction stable direct dyes can further comprise the steps of: providing at least one sulfur dye; and applying said sulfur dye with the reduction stable direct dye and vat dye to said fibrous substrate in the presence of a suitable reducing agent. The sulfur dye is selected from the group of: a non-reduced sulfur dye ($S_1$), a solubilized sulfur dye (Bunte salt) ($S_3$), and combinations thereof. The fibrous substrate is selected from the group of: cellulosic fibrous material, cellulosic-mixed fiber materials, and blends of cellulosic fibers with synthetic non-cellulosic fibers. Suitable reducing agents are selected from the group of: sodium hydrogen sulfide, sodium sulfide, a sodium polysulphide, sodium borohydride, formamidinesulphinic acid, glyceraldehyde, hydroxyacetone, hydroxylamine sulfate, a lignin sulphonate, sodium formaldehydesulphoxylate, sodium hydrosulphite, thioglycolic acid, and one or more of various reducing sugars.

EXAMPLES

Example 1

A dyeing of a textile substrate in a laboratory dyeing apparatus was performed as follows: 10 g of 100% cotton knit interlock is placed in a 150 ml stainless steel dye canister containing 100 ml of dyebath. The dyebath is an aqueous solution consisting of 1 g/L Sandopure° SD, 20 g/L sodium sulfate, 6 g/L soda ash, 4 g/L caustic soda 50% liquid, 9 g/L Sandozol® Reducer RDT-L liquid, 1.1 g of C.I. Sulfur Blue 15, and 0.4 g C.I. Direct Blue 199. The dye canister is then placed in a Zeltex Polycolor laboratory dyeing machine preheated to 50° C. The dyeing machine is then heated to 93° C. at 3° C./minute. The dyeing machine is held at this temperature for 30 minutes and then cooled to 60° C. at 3° C./minute. The dyeing canister is then removed from the dyeing machine and the fabric rinsed under running tap water until clear. The dyed fabric is then oxidized in 100 ml solution containing 1 g/L soda ash and 2 g/L Clariant® Oxidizer A powder at 60° C. for 15 minutes. The fabric is then rinsed with cold water and dried. A bright greenish blue shade having good wash fastness was obtained.

Example 2

A dyeing of a textile substrate in a laboratory dyeing apparatus was performed as follows: 10 g of 100% cotton knit interlock is placed in a 150 ml stainless steel dye canister containing 100 ml of dyebath. The dyebath is an aqueous solution consisting of 1 g/L Sandopure® SD, 20 g/L sodium sulfate, 6 g/L soda ash, 4 g/L caustic soda 50% liquid, 9 g/L Sandozol® Reducer RDT-L liquid, and 0.5 g C.I. Direct Blue 199. The dye canister is then placed in a Zeltex Polycolor laboratory dyeing machine preheated to 50° C. The dyeing machine is then heated to 93° C. at 3° C./minute. The dyeing machine is held at this temperature for 30 minutes and then cooled to 60° C. at 3° C./minute. The dyeing canister is then removed from the dyeing machine and the fabric rinsed under running tap water until clear. The dyed fabric is then oxidized in 100 ml solution containing 1 g/L soda ash and 2 g/L Clariant® Oxidizer A powder at 60° C. for 15 minutes. The fabric is then rinsed with cold water and dried. A bright turquoise blue shade having wash fastness exhibiting more wash down in shade than the dyeing in Example 1 was obtained.

Example 3

A dyeing of a textile substrate in a laboratory continuous dyeing apparatus was performed as follows: a 100% cotton twill is padded at 68–74% wet pick-up with a dyebath solution. The dyebath is an aqueous solution consisting of 75 g/L caustic soda 50% liquid, 75 g/L Sandozol® Reducer RDT-L liquid, 15 g/L sodium hydrosulfite, 122.5 g/L C.I. Sulfur Black 1 and 75 g/L C.I. Direct Blue 199. The dyebath is then heated to 50° C. and held for minutes at this temperature. Then the dyebath solution is added to the dye pad trough. The fabric is then padded through the dyebath solution and steamed for 1 minute at 100–103° C. The dyed fabric is then washed under running tap water until clear. The dyed fabric is then oxidized in an aqueous solution containing 7.5 g/L acetic acid (glacial) and 7.5 g/L Clariant® Oxidizer B liquid at 60° C. for 30 seconds. The fabric is then rinsed with cold water and dried. A bright bluish black shade unachievable with sulfur dyes having good wash fastness was obtained.

Example 4

A dyeing of a textile substrate in a laboratory continuous dyeing apparatus was performed as follows: a 100% cotton unmercerized denim fabric is padded at 68–74% wet pick-up with a dyebath solution. The dyebath is an aqueous solution consisting of 7.5 g/L Penetrant® EH, 22.5 g/L Sulfalox® 100, 45 g/L caustic soda 50% liquid, 75 g/L Sandozol® Reducer RDT-L liquid, 150 g/L C.I. Leuco Sulfur Black 1, and 75 g/L C.I. Direct Blue 199. The dyebath is then heated to 70° C. Then the dyebath solution is added to the dye pad trough. The fabric is then padded through the dyebath solution and steamed for 1 minute at 100–103° C. The dyed fabric is then washed under running tap water until clear. The dyed fabric is then oxidized in an aqueous solution containing 7.5 g/L acetic acid (glacial) and 7.5 g/L Clariant® Oxidizer B liquid at 60° C. for 30 seconds. The fabric is then rinsed with cold water and dried. A unique bright, bluish black shade unachievable with sulfur dyes having good wash fastness was obtained.

Example 5

A dyeing of a textile substrate in a laboratory continuous dyeing apparatus was performed as follows: a 100% cotton twill is padded at 68–74% wet pick-up with a dyebath solution. The dyebath is an aqueous solution consisting of 7.5 g/L Penetrant® EH, 10 g/L sodium chloride, and 75 g/L C.I. Direct Blue 199. The dyebath is then heated to 38° C. Then the dyebath solution is added to the dye pad trough. The fabric is then padded through the dyebath solution and steamed for 1 minute at 100–103° C. The dyed fabric is then washed under running tap water until clear. The dyed fabric is then oxidized in an aqueous solution containing 7.5 g/L acetic acid (glacial) and 7.5 g/L Clariant® Oxidizer B liquid at 60° C. for 30 seconds. The fabric is then rinsed with cold water and dried. A bright turquoise blue shade was obtained. This fabric exhibited poor wash fastness.

Example 6

A dyeing of a textile substrate in a laboratory continuous dyeing apparatus was performed as follows: a 100% cotton twill is padded at 68–74% wet pick-up with a dyebath solution. The dyebath is an aqueous solution consisting of 75 g/L caustic soda 50% liquid, 75 g/L Sandozol® Reducer RDT-L liquid, 15 g/L sodium hydrosulfite, and 75 g/L C.I. Direct Blue 199. The dyebath is then heated to 50° C. and held for 5 minutes at this temperature. Then the dyebath solution is added to the dye pad trough. The fabric is then padded through the dyebath solution and steamed for 1 minute at 100–103° C. The dyed fabric is then washed under running tap water until clear. The dyed fabric is then oxidized in an aqueous solution containing 7.5 g/L acetic acid (glacial) and 7.5 g/L Clariant® Oxidizer B liquid at 60° C. for 30 seconds. The fabric is then rinsed with cold water and dried. A bright turquoise blue shade having more color value than Example 5 was obtained.

Example 7

A dyeing of a textile substrate in a laboratory dyeing apparatus was performed as follows: 10 g of 100% cotton knit interlock is placed in a 150 ml stainless steel dye canister containing 100 ml of dyebath. The dyebath is an aqueous solution consisting of 1 g/L Sandopure® SD, 20 g/L sodium sulfate, 6 g/L soda ash, 4 g/L caustic soda 50% liquid, 9 g/L Sandozol® Reducer RDT-L liquid, 1.05 g C.I. Sulfur Blue 15, 0.096 g C.I. Direct Yellow 29, and 0.026 g C.I. Direct Blue 199. The dye canister is then placed in a Zeltex Polycolor laboratory dyeing machine preheated to 50° C. The dyeing machine is then heated to 93° C. at 3° C./minute. The dyeing machine is held at this temperature for 30 minutes and then cooled to 60° C. at 3° C./minute. The dyeing canister is then removed from the dyeing machine and the fabric rinsed under running tap water until clear. The dyed fabric is then oxidized in 100 ml solution containing 1 g/L soda ash and 2 g/L Clariant® Oxidizer A powder at 60° C. for 15 minutes. The fabric is then rinsed with cold water and dried. A bright blue-green shade having good overall wet fastness properties was obtained.

Example 8

A dyeing of a textile substrate in a laboratory dyeing apparatus was performed as follows: 10 g of 100% cotton knit interlock is placed in a 150 ml stainless steel dye canister containing 100 ml of dyebath. The dyebath is an aqueous solution consisting of 1 g/L Sandopure® SD. 20 g/L sodium sulfate, 6 g/L soda ash, 4 g/L caustic soda 50% liquid, 9 g/L Sandozol® Reducer RDT-L liquid, and 0.4 g C.I. Direct Yellow 148:1. The dye canister is then placed in a Zeltex Polycolor laboratory dyeing machine preheated to 50° C. The dyeing machine is then heated to 93° C. at 3° C./minute. The dyeing machine is held at this temperature for 30 minutes and then cooled to 60° C. at 3° C./minute. The dyeing canister is then removed from the dyeing machine and the fabric rinsed under running tap water until clear. The dyed fabric is then oxidized in 100 ml solution containing 1 g/L soda ash and 2 g/L Clariant® Oxidizer A powder at 60° C. for 15 minutes. The fabric is then rinsed with cold water and dried. A bright lemon yellow shade was obtained.

Example 9

A dyeing of a textile substrate in a laboratory dyeing apparatus was performed as follows: 10 g of 100% cotton knit interlock is placed in a 150 ml stainless steel dye canister containing 100 ml of dyebath. The dyebath is an aqueous solution consisting of 1 g/L Sandopure® SD, 20 g/L sodium sulfate, 6 g/L soda ash, 4 g/L caustic soda 50% liquid, 9 g/L Sandozol® Reducer RDT-L liquid, and 0.4 g C.I. Direct Red 254. The dye canister is then placed in a Zeltex Polycolor laboratory dyeing machine preheated to 50° C. The dyeing machine is then heated to 93° C. at 3° C./minute. The dyeing machine is held at this temperature for 30 minutes and then cooled to 60° C. at 3° C./minute. The dyeing canister is then removed from the dyeing machine and the fabric rinsed under running tap water until clear. The dyed fabric is then oxidized in 100 ml solution containing 1 g/L soda ash and 2 g/L Clariant® Oxidizer A powder at 60° C. for 15 minutes. The fabric is then rinsed with cold water and dried. A very weak dull brown shade was obtained.

Example 10

A dyeing of a textile substrate in a laboratory continuous dyeing apparatus was performed as follows: 100% cotton unmercerized, 6/1 warp yarn is padded at 68–74% wet pick-up with a dyebath solution. The dyebath is an aqueous solution consisting of 10 g/L caustic soda 50% liquid, 5 g/L sodium hydrosulfite, 10 g/L sodium chloride, and 5.6 g/L C.I. Direct Blue 199. The dyebath is vatted at 25° C. for 1 hour. The vatted dye solution is then added to the dye pad trough. The pre-scoured yarn is then padded through the dye solution with 20 second immersion and skied for 2 minutes. The yarn is then padded through the dye solution with 20 second immersion and skied for 2 minutes a second time. The dyed yarn is then washed under running tap water until clear and dried. A very weak green shade was obtained.

Example 11

A dyeing of a textile substrate in a laboratory continuous dyeing apparatus was performed as follows: 100% cotton unmercerized, 6/1 warp yarn is padded at 68–74% wet pick-up with a dyebath solution. The dyebath is an aqueous solution consisting of 10 g/L caustic soda 50% liquid, 5 g/L sodium hydrosulfite, 10 g/L sodium chloride, and 5.6 g/L Indigo 20% paste. The dyebath is vatted at 25° C. for 1 hour. The vatted dye solution is then added to the dye pad trough. The pre-scoured yarn is then padded through the dye solution with 20 second immersion and skied for 2 minutes. The yarn is then padded through the dye solution with 20 second immersion and skied for 2 minutes a second time. The dyed yarn is then washed under running tap water until clear and dried. A medium depth blue shade was obtained.

Example 12

A dyeing of a textile substrate in a laboratory continuous dyeing apparatus was performed as follows: 100% cotton unmercerized, 6/11 warp yarn is padded at 68–74% wet pick-up with a dyebath solution. The dyebath is an aqueous solution consisting of 10 g/L caustic soda 50% liquid, 5 g/L sodium hydrosulfite, 10 g/L sodium chloride, and 5.6 g/L Indigo 20% paste, and 10 g/L C.I. Direct Blue 199. The dyebath is vatted at 25° C. for 1 hour. The vatted dye solution is then added to the dye pad trough. The pre-scoured yarn is then padded through the dye solution with 20 second immersion and skied for 2 minutes. The yarn is then padded through the dye solution with 20 second immersion and skied for 2 minutes a second time. The dyed yarn is then washed under running tap water until clear and dried. A bright blue shade having more than twice the color value as Example 11 was obtained.

What is claimed is:

1. A concentrated pourable aqueous liquid dye composition substantially free of any organic solvent and capable of reduction, comprising: a pre-reduced sulfur dye, at least one reduction stable direct dye, and a suspension stabilizing agent in an amount effective to maintain uniform distribution of the sulfur dye and/or direct dye in suspension for a period of at least 24 hours.

2. A concentrated pourable aqueous liquid dye composition according to claim 1, said suspension stabilizing agent being present in an amount of less than 10% by weight of the composition.

3. A concentrated pourable aqueous liquid dye composition according to claim 2, wherein the suspension stabilizing agent is selected from the group of: carboxymethyl cellulose, xantham gum, gum arabic, polyacrylamide, and combinations thereof.

4. A concentrated pourable aqueous liquid dye composition according to claim 1, further comprising an additive selected from the group of: a preservative, a biocide, a fungicide, and combinations thereof.

5. A concentrated pourable aqueous liquid dye composition according to claim 2, further comprising an additive selected from the group of: a preservative, a biocide, a fungicide, and combinations thereof.

* * * * *